US010280032B2

(12) United States Patent
Barea

(10) Patent No.: US 10,280,032 B2
(45) Date of Patent: May 7, 2019

(54) THREAD FEEDER OF ROTARY DRUM TYPE WITH DETECTION OF THE DENSITY OF THREAD PRESENT THEREON

(71) Applicant: BTSR INTERNATIONAL S.P.A., Olgiate Olona (IT)

(72) Inventor: Tiziano Barea, Busto Arsizio (IT)

(73) Assignee: BTSR INTERNATIONAL S.P.A., Olgiate Olona (VA) (IT)

( * ) Notice: Subject to any disclaimer, the term of this patent is extended or adjusted under 35 U.S.C. 154(b) by 26 days.

(21) Appl. No.: 15/549,680

(22) PCT Filed: Jan. 22, 2016

(86) PCT No.: PCT/IB2016/050338
§ 371 (c)(1),
(2) Date: Aug. 9, 2017

(87) PCT Pub. No.: WO2016/128851
PCT Pub. Date: Aug. 18, 2016

(65) Prior Publication Data

US 2018/0029823 A1 Feb. 1, 2018

(30) Foreign Application Priority Data

Feb. 12, 2015 (IT) ..... MI2015U0031 U

(51) Int. Cl.
*B65H 51/22* (2006.01)
*D03D 47/36* (2006.01)
*D04B 15/48* (2006.01)

(52) U.S. Cl.
CPC ..... *B65H 51/22* (2013.01); *D03D 47/367* (2013.01); *D04B 15/486* (2013.01); *B65H 2553/414* (2013.01); *B65H 2701/31* (2013.01)

(58) Field of Classification Search
CPC .. B65H 51/22; B65H 2701/31; D03D 47/367; D04B 15/486
See application file for complete search history.

(56) References Cited

U.S. PATENT DOCUMENTS 4,687,149 A 8/1987 Riva
5,590,547 A 1/1997 Conzelmann
(Continued)

FOREIGN PATENT DOCUMENTS

WO 2008055571 A1 5/2008
WO 2012085141 A2 6/2012

OTHER PUBLICATIONS

International Search Report and Written Opinion dated May 9, 2016 for PCT/IB2016/050338 to ABTSR International S.P.A. filed Jan. 22, 2016.

*Primary Examiner* — William E Dondero
(74) *Attorney, Agent, or Firm* — Vorys, Sater, Seymour and Pease LLP

(57) ABSTRACT

Accumulation-type thread feeder including: a body, which bears a rotary drum on which turns of thread from a spool are wound; a tension sensor for detecting value of tension of exiting thread and a detector for detecting thread quantity accumulated on the drum; a light-reflecting element on the drum or functionally associated therewith, such light generated by light a generator borne by a support arranged alongside the drum, the support associated with a detector to detect light reflected by the reflecting element, the reflected light varying as a function of the quantity of thread wound on the rotary drum, the detection allowing detection of such thread quantity. The detector is a light-sensitive member directly receiving the light reflected by the reflecting element along the entire surface of the drum, the member allowing determination of thread density on the drum.

9 Claims, 4 Drawing Sheets

(56) References Cited

U.S. PATENT DOCUMENTS

| | | | | | |
|---|---|---|---|---|---|
| 5,765,399 | A * | 6/1998 | Huss | D03D 47/367 | 139/452 |
| 6,044,871 | A * | 4/2000 | Zenoni | D03D 47/367 | 139/452 |
| 2013/0119177 | A1 * | 5/2013 | Barea | B65H 51/22 | 242/365.7 |

* cited by examiner

THREAD FEEDER OF ROTARY DRUM TYPE WITH DETECTION OF THE DENSITY OF THREAD PRESENT THEREON

CROSS-REFERENCE TO RELATED APPLICATIONS

This is a § 371 National Stage Application of International Application No. PCT/IB2016/050338 filed on Jan. 22, 2016, claiming the priority of Italian Patent Application No. MI2015U000031 filed on Feb. 12, 2015.

The object of the present invention is a thread feeder with rotary drum.

The invention, in particular, is intended for a feeder of thread or yarn to a textile machine or to an operating machine having means adapted to determine the quantity of thread (also metal or plastic) or yarn (textile) present on said drum during the feeding thereof, in order to ensure that such feeding can occur in an optimal manner and in particular keeping the characteristics constant (such as the tension, speed or quantity) of the thread or yarn during such feeding.

Various types of feeders or feeding devices are known, in particular for feeding yarn to a textile machine, having means adapted to allow the detection of the position of the thread distributed on a rotating or stopped drum, so as to allow keeping the quantity of thread accumulated on the drum itself under control.

Such devices can, for example, have a body bearing a wheel or static cylinder around which the thread is arranged, which completes one or more turns. The cylinder on which the supply of thread is wound has, on the lateral surface thereof, one or more bending tabs arranged arranged vertically and movably, with an opening/closing mechanism with respect to such surface. Such tabs allow the detection of the presence of the thread and, indirectly, the quantity: indeed, the thread, by winding around the cylinder, over time covers the surface of the bending tabs, which, being closed due to the pressure exerted by the thread itself, allow detecting the presence of the thread.

Such "mechanical" solution allows, through the use of the single or multiple foldable tabs, checking the presence of thread on the drum, said tabs being closed (i.e. re-entering within the cylinder or being folded thereon) due in fact to the pressure of the thread which is wound on the drum; however, said solution does not allow precisely measuring the quantity of thread present. Said solution therefore does not allow adjusting the quantity of thread deposited on the drum in accordance with the production needs and hence does not allow the user to be able to timely manage the supply of thread wound on the drum.

The device is also subjected to mechanical stresses due in fact to the nature of its measurement element: indeed, the bending tabs can be damaged or worn over time due to regular use, which negatively affects the functionality of the device. Dirt accumulation can also deteriorate the mechanism that allows the movement of the tabs, which therefore can be easily affected by external factors and hence be intrinsically unreliable.

Finally, when the device is feeding a low-tension thread, the negative pressure exerted by the tabs arranged on the drum will tend to outwardly push the thread which is wound around the drum itself, coming to condition the work tension of the thread itself. Actually, this negative pressure action by the tabs, in addition to negatively affecting the working tension of the thread, involves greater mechanical stress on the thread itself, which could over time be deteriorated or broken.

Other types of feeder devices are also known which have means adapted to detect the presence of the thread on a drum or cylinder, thus indirectly also detecting the quantity thereof through a system of light reflected by the drum itself. For example, a device is known having a body, on which a static wheel or drum is applied whose external surface is made of light-reflecting material. Arranged in front of the drum, on a support for the body itself of the device, is placed a light generator and a sensor whose function is to measure the quantity of light reflected by the drum and through this the quantity of thread turns created on the drum itself. In the operation of the device, the thread that is wound around the wheel reduces the capacity of reflection by the drum towards the sensor, which in response will detect the presence of the thread and indirectly measure the quantity thereof through the reading of the number of turns wound around the drum.

Such known solution has considerable limits, in particular dictated by the characteristics of the fed thread.

Since the device comprises the transmitter of a light signal and the sensor receiving the reflected signal, which interact with the reflecting surface of the drum itself, given that the system is of static type and such signal continuously generated, a control unit connected to the sensor is unable to tell if the drum surface reflection is prevented due to the thread wound thereon or for example to an accumulation of dirt interposed between the surface of the drum and the sensor. In addition, in case of use of a thread of metal type or provided with intrinsic characteristics that in turn render it reflecting, the control unit will once again be unable to decipher the presence of the thread itself on the drum, not being able to distinguish the reflection generated by the thread from that generated by the surface of the drum itself.

Therefore, the abovementioned known device, in addition to constraining the production—not allowing the use of some types of thread—can be easily affected by external factors that are very common during production (such as dirt accumulations) and therefore particularly limiting for the user.

U.S. Pat. No. 5,590,547, which is considered the most pertinent state of the art describes a thread feeder with rotary drum having a body (bearing such drum) having a portion facing the drum itself.

The latter comprises a plurality of spaced elements or bars defining the surface of the drum between which other bar elements (which are moved into slits present between the spaced bars) are movable that are adapted to move the thread that is accumulated on the drum from an inlet zone thereon towards an outlet zone from which the thread is moved away in order to be sent to a textile machine.

The bar elements are part of a member rotating eccentrically with respect to the drum and arranged at the interior thereof.

One of said bar elements or of said spaced bars is made to reflect the light emitted by two light sources associated with the portion facing the rotary drum, such sources arranged at the upper turn and lower turn, respectively, created by the thread on the drum.

A light-transparent element generated by said sources, having a plurality of lenses (curved on one face thereof), is interposed between said sources and the rotating drum. Devices reflecting the reflected light are instead arranged on a same support of the light sources.

Such detector devices and sensors allow verifying the presence/absence of the thread on the drum and maintaining unaltered over time the quantity of turns wound thereon. This device type, being part of that category of feeders with rotary drum, attains its object also due to the movement of the drum itself, the zones of light reflection and non-reflection being alternated on the surface thereof. This occurs also by using the light-transparent element which, due to the alternation of planar and convex surfaces, allows an improved refraction of the signal emitted by the sensors, amplifying them and improving the quantity of the measurement.

The device described in U.S. Pat. No. 5,590,547 mainly has considerable structural difficulty since it comprises a multiplicity of components which potentially increase the complexity of the device itself, having an effect on the structural practicality and on the production cost thereof. One such device has intrinsic limits such as the need for extreme precision during mounting and applications on the textile machines, in addition to being subject to a higher probability of component damage, or in any case to a higher wear thereof, such to preclude over time a regular use of the device without continuous maintenance operations.

Other devices are known in the art, such as that reported in WO2008055571, in which a thread feeder of fixed drum type is described having means which allow detecting the presence or absence of thread wound on the drum through the use of an electrical-optical sensor that works in combination with a reflecting surface present on the drum itself. Such known device has drawbacks mainly tied to the fact that the drum is stopped and not moving, which has considerable negative effect on the device's possibility for precision, increasing the possibility for dirt deposit which over time would negatively impact device performances.

Other devices, like that described for example in WO2012085141, belonging to the category of the feeder devices with fixed drum, have means which allow verifying the presence of the thread on the fixed drum through the use of at least one pair of emitting/receiving sensors and of a series of mirrors and lenses which allow an increased precision in the emission and in the reception of the signal. This type of device in fact uses a first and a second group of mirrors, the first with total reflection and the second with spatial reflection. The mirrors are arranged with specific angles and are interposed between the sensor and the drum. The light signal passes through these mirrors and allows the detection of the presence/absence of the thread.

Also with regard to the invention described in WO2012085141, the complex mechanism of lenses and mirrors associated with the use of one or more pairs of emitting/receiving sensors drastically decreases the simplicity of the device, at the same time negatively affecting its performances (e.g. a non-alignment of the mirrors or a variation of the tilt angle of the mirrors themselves would risk no longer allowing the regular operation of the device itself.

Object of the present invention is to make a feeder of accumulation type, with rotary drum, which is able to effectively control the quantity of the thread present on the aforesaid drum, precisely detecting the presence or absence of such thread on the drum.

Another object is to make a feeder of the aforesaid type that allows for obtaining the aforesaid control without modifying the outlet tension from the rotary drum of the thread, i.e. by keeping the latter constant, and also by keeping the quantity of thread or supply accumulated on the drum constant.

A further object consists of making a feeder of the aforesaid type which has a reduced number of components with respect to the analogous known devices, allowing the increase of feeder reliability.

Still another object consists of making a feeder of the aforesaid type which allows setting, as a function of requirements, the number of turns or supply to be accumulated on the drum.

A further object consists of making a feeder of the aforesaid type in which the control of the supply of thread present on the drum is independent of the type of such thread.

A further object is to offer a feeder of the abovementioned type in which the control of the quantity of thread present on the drum is independent of the possible accumulation of dirt on the drum itself or on the device in its entirety.

These objects area attained due to the thread feeder, of accumulation type, with rotary drum, according to the enclosed claims.

In order to better comprehend the present invention, the following drawings are enclosed by way of a merely non-limiting example, in which.

Figure 1:
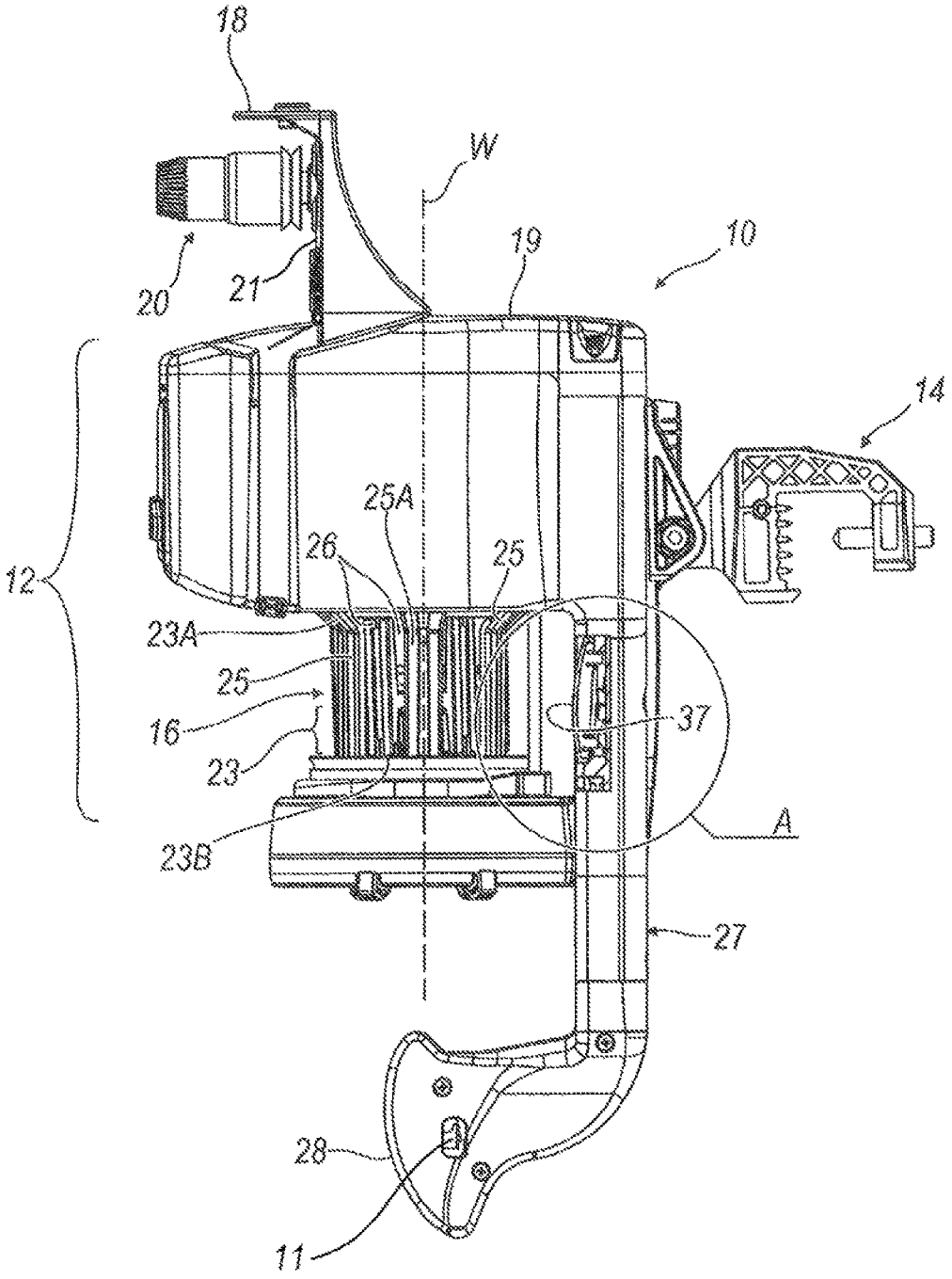
FIG. 1 is a side view of a feeder according to the present invention.
Figure 2:
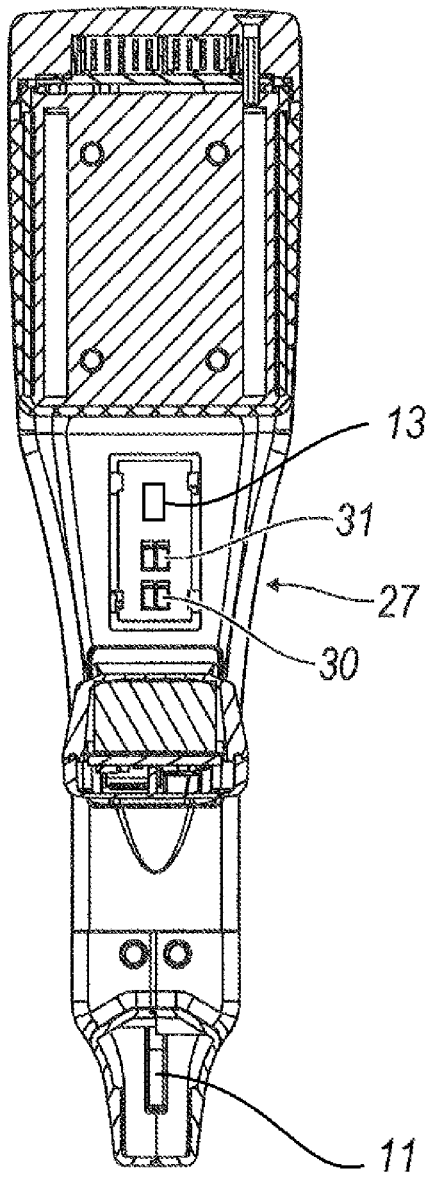
FIG. 2 is an enlarged view of the part indicated with A in FIG. 1.

With reference to FIGS. 1 and 2, a thread feeder, indicated overall with reference number 10, is of accumulation type and comprises a main body 12 associated with a suitable support 14 and supporting a rotary drum 16 with vertical axis W; on such drum, a specific number of turns (not shown) of a thread coming from a spool (not shown) are wound. The entering thread, i.e. before reaching the drum 16, normally passes through a thread guide 18 associated with an upper part 19 of the body 12 which defines the inlet trajectory of the thread into the feeder 10 and prevents such thread from coming into direct contact with the body 12.

In proximity to such thread guide 18, a normal adjustable braking member 20 is present which is borne, with the thread guide, by a bracket 21 integral with the part 19 of the body 12.

The drum 16 has the task of accumulating a pre-established (possibly or preferably programmable) number of thread turns coming from the spool and to feed the latter to a textile machine (not shown). The drum 16 simultaneously allows separating the turns in a manner such they cannot be overlapped and consequently "pinched" together.

The drum 16 is made to rotate by an electric motor arranged in the body 12 (not shown) and it has a surface 23 on which the thread is wound; such thread at least partially occupies such surface between an upper end 23A and a lower end 23B. In particular, the thread coming from the thread guide 18 and from the braking member 20 reaches the aforesaid end 23A of the surface 23 in a known manner, is wound on the latter and exits from the drum of the lower end 23B of said surface.

The latter, in particular, is defined by a plurality of bar elements 25 arranged along a common circumference so as to define the cylindrical form of the drum. The elements 25 are spaced from each other and within slits 26 such that, present therebetween, tabs of a member are moved which are adapted to separate the turns from each other and to "push them" towards the outlet of the drum, i.e. its end 23B.

Under the drum, a tension sensor 11 is arranged, present at a free end 28 of a support 27 arranged laterally with respect to the rotary drum 16 and constrained to the body 12 of the feeder or feeding device 10.

The support 27 is associated with a circuit board bearing LED or light generator means 30 and light detector means 31. Such detector means or sensor 31 detect the light which, generated by LED means 30, is reflected by at least one of the bar elements 25 (which in FIG. 1 is identified as 25A). Each of such reflecting elements 25A—which can have the flat, concave or convex reflecting surface attained by means of the application on the element itself of a layer, for example of an adhesive or metal blade—is capable of separately or overall generating reflected light which covers the entire surface 23, from the end 23A to the end 23B.

The reflected light that thus affects a complete zone of the surface between its two opposite ends 23A, 23B is detected by the sensor 31, which can therefore receive light (reflected) by a longitudinal zone of the surface 23 comprised between the two ends thereof. Therefore, such sensor 31 not only detects the light reflected by one or more (limited) parts of the surface 23, but also detects the light reflected by the entire longitudinal portion (corresponding to that where the element 25A is arranged) of such surface.

Since the presence of the thread (or better yet of its turns) on the surface 23 interferes with the reflection of the light by the element 25A (or better yet tends to prevent it), as a function of the (reflected) light signal actually received by the sensor 31 it is possible to know the density of thread accumulated on the drum 16 and therefore indirectly know the quantity thereof.

In order to have an optimal detection, the sensor 31 could be a CCD sensor. Of course, this is connected to a control unit 13 which receives the data generated by the sensor 31 as a function of the detected light and which determines, according to a comparison algorithm, the density of thread wound on the drum. Such algorithm, in particular, compares the light values detected by the sensor 31 in the absence of thread on the drum with detected values linked to the accumulation of thread on the drum itself In particular, the control algorithm continuously compares the value detected by the sensor with a reference value, possibly stored during a calibration step or detected in real time by another sensor that works in the same manner, but arranged in a position of the drum on which the thread is not deposited.

Alternatively, instead, the control algorithm combines the information received (i.e. the detected value) by the first sensor with a light value detected by a second sensor arranged in a zone adjacent to the first, but distributed along the axis of the drum. In this case, the two sensors actually work and "read" two adjacent drum portions and the control algorithm monitoring the progression of the two signals is able to compensate for reading errors due to the presence of dirt or external noise (such as ambient light) conditions; in practice, the system will operate with differential mode. If the reading of the value generated by the first sensor (arranged in the lower portion of the drum) coincides with the reading of the value generated by the second sensor (arranged in the upper portion of the drum), it will be detected that the drum is being unloaded or is completely loaded. When instead, the first sensor generates a value greater than the second sensor, this is an indication of the fact that the drum is being loaded; vice versa, the drum is being unloaded.

Alternatively, instead, by always working with two adjacent sensors, the second sensor arranged higher (along the axis of the drum 16) is used as measurement reference for the first sensor, whose value (greater, smaller or equal) determines the loading state of the drum.

Therefore, from this comparison the control electronics are capable of detecting the density of the thread present on the drum.

In front of the sensor 31, a transparent "window" 37 is arranged, having a convex shape (concave towards the sensor 31).

During the use of the accumulator, each reflecting element arranged on the drum 16, due to the circular movement thereof, interacts with the sensor 31 arranged in the support 27 which lies opposite, and as a result such sensor detects the density of thread wound around the drum. The detection of the presence of the thread is obtained due to the fact that, over time, the thread, being wound around the drum 16, comes to partially or totally cover the surface of each reflecting element. This total or partial coverage of the reflection elements will prevent the same from completely reflecting the light towards the sensor 31. From the decoding of the signal emitted by the latter as a function of the received light signal, the control unit obtains data that precisely expresses the density of the thread wound on the drum.

The precision of the system is in fact ensured by the alternation of at least one reflecting surface with at least one non-reflecting surface. This alternation is allowed by the presence of at least one reflecting element 25A arranged on the external surface 23 of the drum.

During a normal revolution of the drum (360°), the LED or equivalent light transmitter element 30 emits a signal which intercepts, one or more times, the reflecting element arranged on the drum 16 itself which by reflecting the light signal towards the sensor 31, allows the control unit to "decipher" how much reflecting surface is free of thread. The advantage of having a CCD as sensor lies in the fact that it allows reading/controlling a greater area of the drum 16 since it can receive the reflected light along the entire longitudinal area of the surface 23 (i.e. that between its ends 23A and 23B) occupied by each reflecting element 25A. On the basis of the reflecting surface of the element 25A free of thread, the control unit can identify the density and hence the quantity of thread present on the drum and drive a rotation of the latter in order to facilitate (or prevent) the winding of further thread or the unwinding thereof from the drum itself (and the sending to the operating or textile machine).

The surface area of the reflecting element 25A that reflects the light (and detected as 'free' by the sensor 31) is inversely proportional to the quantity of thread wound on the drum and the control of the latter can be carried out in a direct manner: if it is desired to increase the accepted quantity of thread that is wound on the drum, it is sufficient to set a different limit for the response signal generated by the sensor 31 on the basis of the light "emitted" (e.g. reflected) by the reflecting element 25A. This limit, if increased, will involve a decrease of the number of turns wound on the drum, while if decreased it will involve an increase of such turns. This occurs through the action of the control unit (connected to the sensor 31) on the electric motor that operates the rotation of the drum.

The presence of multiple reflecting elements 25A arranged on the drum 16 increases the precision of the system since the control algorithm is capable of making more decisions within one cylinder revolution.

Due to the fact that the drum during the working steps is moving, the alternation of reflecting elements spaced by non-reflecting elements generates a pulsed and intermittent signal that allows precisely recognizing the presence of the thread and its density even in the case of possible accumulation of dirt or of a reflecting thread.

With reference to FIGS. 3-6, the signal generated by the sensor 31 in the absence of thread on the drum is shown therein. The signal comprises a series of pulses 50 of equal intensity separated by a definite time interval 51. Of course, each revolution of the drum corresponds with a number of pulses (50) equal to the number of reflecting elements, spaced by non-reflection zones (51).

Each single pulse corresponds with the point at which the sensor 31 intercepts the light reflected by the reflecting element 25A arranged on the drum 16. The intensity of the pulse is an inverse function of the density of thread wound on the drum 16 and thus the greater the intensity of the pulse, the smaller the density of thread wound on the wheel.

Figure 3:
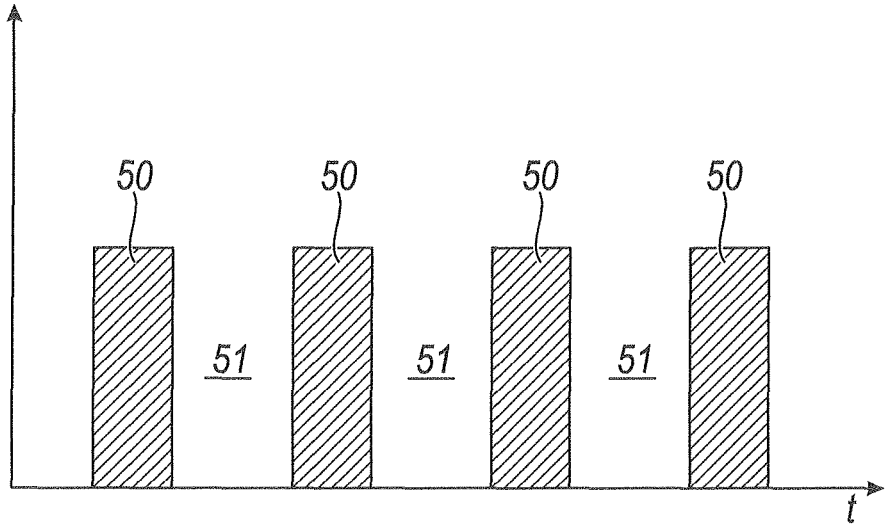
FIGS. 3-6 are graphs showing the signals or pulses generated by a detector element of the feeder of FIG. 1 during its use according to the invention.
Figure 4:
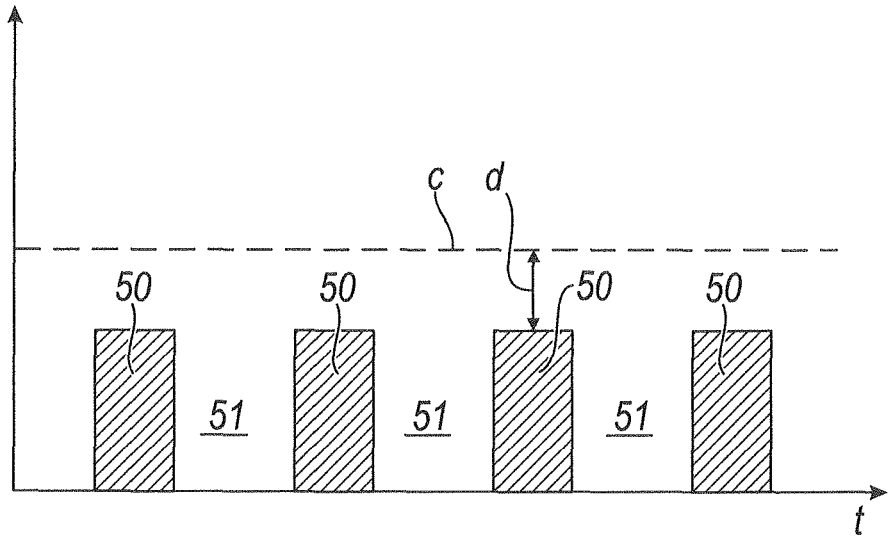

FIG. 4 shows the detection of an average density of thread wound on the drum: as can be inferred from the figure, the intensity of the pulses 50 is reduced with respect to the situation of FIG. 3.

It is thus inferred that the difference d between the intensity of the pulse in a situation with drum unloaded, determined from the line c, and the intensity of the pulse in the presence of turns wound on the drum 16 is a function of the density of the thread itself.

Figure 6:
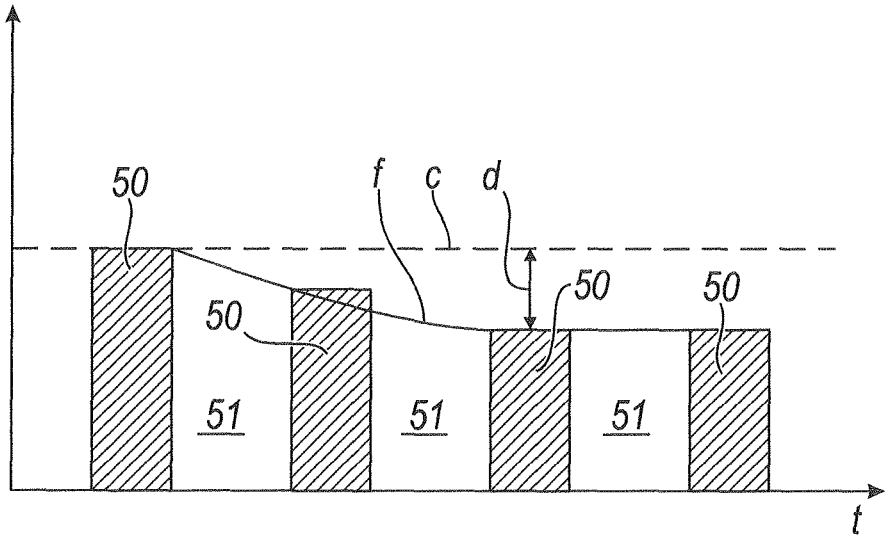

FIG. 6 shows the variation (curve f) of the intensity of the pulses over time with the variation of the density of thread present on the drum.

It is underlined that the device is also programmed for having a maximum limit and a minimum limit for the intensity of the pulses, such to render cases of complete absence of the thread or of excessive accumulation on the drum easily identifiable, possibly generating alarms.

Figure 5:
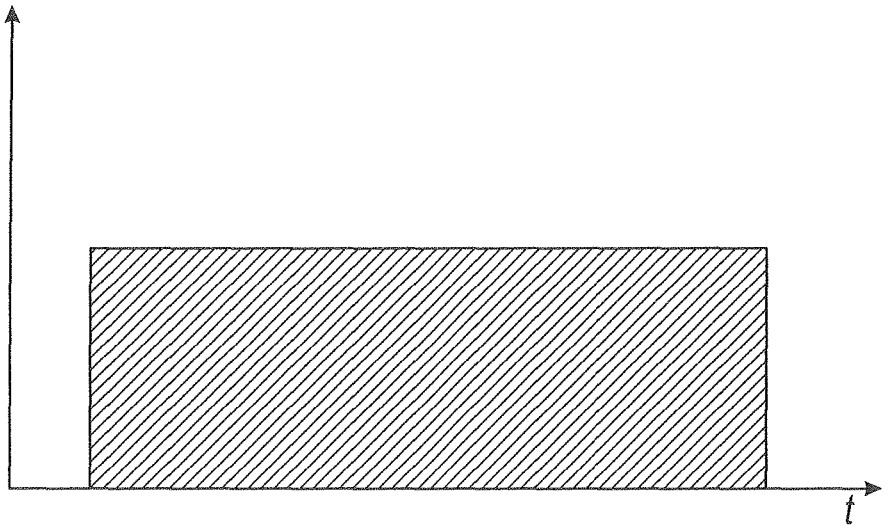

The continuous alternation of reflecting and non-reflecting zones also allows intercepting, with absolute certainty, the limit conditions such as a drum with excessive load (the control electronics do not detect any reflection peak 50) or the presence of an extremely reflecting thread, in this case the sensor would detect a continuous signal (FIG. 5).

Therefore, the feeder 10 according to the invention is not only able to detect the presence of any type of textile thread, but it is also able to manage the supply wound on the drum in complete autonomy, keeping it constant over time in accordance with the requirements, and with extreme precision.

It is therefore clear that the invention, with respect to the known solutions (whose limits have been described above), represents an inventive step, increasing the capacity of a feeding device and allowing ever-increasing precision in the control exerted on the feeding of the thread to a textile machine.

Preferably, in order to have greater detection precision, the presence is provided of a second series of reflecting elements and corresponding light generator means and sensors only arranged in proximity to the upper end 23A of the surface 23 of the drum 16 and in a distal position with respect to the main series. The detection of the light reflected by such second series of reflecting elements, arranged in a position in which an absence of thread is normally detected, gives in response a signal (defined as standard) like an alternation of reflection/non-reflection steps that is defined and constant over time.

Therefore, if a metal thread is used, or a thread is used with characteristics such to make it in turn reflecting, through the comparison of the signals generated by the two series of sensors, it is possible to understand if the continuous reflected light signal detected by the sensor 31 or "main" sensor as an error (e.g. irregularity, dirt accumulation or failure) or due to the actual presence of a thread with particular characteristics, allowing a timely setting of the device which therefore continues to perform its function of feeding and control of the supply of thread wound on the drum.

Due to the invention, it is possible to decide, and maintain constant over time, the density of turns (hence the supply) to be accumulated on the drum.

In addition, the actuation of the invention does not involve any impediment of the correct feeder device operation due to particular characteristics of the thread used and, with respect to the known solutions, there is a lower possibility of operation interruption due to mechanical failures or deteriorations of the device in the thread detection part thereof.

The invention allows greater precision in maintaining constant over time the tension of the thread and the quantity of supply accumulated on the drum 16 and does not generate any effect on the tension of the thread during its unwinding from the drum, nor friction caused by mechanical members for measuring the deposited thread supply.

Due to the use of the sensor 31 made as CCD, it is possible to read/control a greater area of the drum with respect to that done in the known solutions.

In addition, the rotation of the drum ensures a perfect alignment between each reflecting element and the sensor 31, without having to have absolute mechanical precision.

Finally, the reflecting element is mounted on the drum 16 at a height such that the passing thread can clean it, thus eliminating the problem of possible dirt accumulation.

Of course, the control unit can detect problems in the creation of the supply on the drum and generate alarms due to excessive supply and insufficient supply, always working on the received reflection value.

The invention claimed is:

1. A feeder of thread or yarn, intended for an operating machine or a textile machine, said feeder being of accumulation type and comprising:

a body which bears a rotary drum having a surface on which thread turns coming from a spool are wound;

a tension sensor for detecting the tension value of the thread exiting from the drum and a thread quantity detector for detecting the quantity of thread accumulated thereon, said thread quantity detector comprising a light-reflecting element arranged along the surface of the drum, such light being generated by a light generator borne by a support arranged alongside the rotary drum, said support being associated with a reflected light detector or sensor adapted to detect the light reflected by said reflecting element, said reflected light varying as a function of the quantity of thread wound on said rotary drum, said detection allowing the detection of such thread quantity, the reflected light detector being at least one light-sensitive member that receives the light reflected by said reflecting element, said light-sensitive member allowing the determination of the density of the thread present on the drum, wherein the feeder comprises a plurality of the reflecting elements arranged along the surface of the rotary drum that are separated by a zone not reflecting the light emitted by the light generator, wherein two light-sensitive members distributed around the drum and borne by said support detect the signal reflected by a single said reflecting element, said signal being analyzed and compared in differential mode between the signal received by the first light-sensitive member and the signal received by the second light-sensitive member, so as to automatically compensate for and cancel out disturbances caused by the effect of the ambient light and possible deposit of yarn residues or dust on said reflecting element and/or light-sensitive members.

2. The feeder according to claim 1, wherein at least one said light-sensitive member is a CCD sensor.

3. The feeder according to claim 2, wherein on the surface of the drum, in a position such to certainly not be covered by the thread or yarn, at least one further reflecting element is provided that is adapted to cooperate with corresponding said light generator and with corresponding reflected light detector or sensor of reflected light borne by the support, said at least one further reflecting element allowing the obtainment of a reflected light signal on an area of the drum not covered by the thread, and adapted to act as a reference and comparison with the reflected light signal generated by each reflecting element arranged along the surface of the drum on which the thread is wound.

4. The feeder according to claim 1, wherein the first light-sensitive member is a CCD sensor and the second light-sensitive member is a CCD sensor.

5. The feeder according to claim 1, wherein said light generator and said reflected light detector or sensor is connected to a controller which, as a function of the light signals received by the reflected light detector or sensor, determine the density of the thread present on said rotary drum by comparison between signals emitted by said detector means or sensors following the reception of the aforesaid light signals and preset data, the quantity of the thread present on the rotary drum being defined on the basis of such density determination.

6. A feeder of thread or yarn, intended for an operating machine or a textile machine, said feeder being of accumulation type and comprising:

a body which bears a rotary drum having a surface on which thread turns coming from a spool are wound;

a tension sensor for detecting the tension value of the thread exiting from the drum and a thread quantity detector for detecting the quantity of thread accumulated thereon, said thread quantity detector comprising a light-reflecting element arranged along the surface of the drum, such light being generated by a light generator borne by a support arranged alongside the rotary drum, said support being associated with a reflected light detector or sensor adapted to detect the light reflected by said reflecting element, said reflected light varying as a function of the quantity of thread wound on said rotary drum, said detection allowing the detection of such thread quantity, the reflected light detector being at least one light-sensitive member that receives the light reflected by said reflecting element, said light-sensitive member allowing the determination of the density of the thread present on the drum, wherein the feeder comprises a plurality of the reflecting elements arranged along the surface of the rotary drum that are separated by a zone not reflecting the light emitted by the light generator, wherein on the surface of the drum, in a position such to certainly not be covered by the thread or yarn, at least one further reflecting element is provided that is adapted to cooperate with corresponding said light generator and with corresponding reflected light detector or sensor of reflected light borne by the support, said at least one further reflecting element allowing the obtainment of a reflected light signal on an area of the drum not covered by the thread, and adapted to act as a reference and comparison with the reflected light signal generated by each reflecting element arranged along the surface of the drum on which the thread is wound.

7. The feeder according to claim 6, wherein said light generator and said reflected light detector or sensor is connected to a controller which, as a function of the light signals received by the reflected light detector or sensor, determine the density of the thread present on said rotary drum by comparison between signals emitted by said detector means or sensors following the reception of the aforesaid light signals and preset data, the quantity of the thread present on the rotary drum being defined on the basis of such density determination.

8. The feeder according to claim 7, wherein at least one said light-sensitive member is a CCD sensor.

9. The feeder according to claim 6, wherein at least one said light-sensitive member is a CCD sensor.

* * * * *